United States Patent [19]

Yamato et al.

[11] Patent Number: 4,753,208

[45] Date of Patent: Jun. 28, 1988

[54] METHOD FOR CONTROLLING AIR/FUEL RATIO OF FUEL SUPPLY SYSTEM FOR AN INTERNAL COMBUSTION ENGINE

[75] Inventors: Akihiro Yamato; Akira Fujimura, both of Wako, Japan

[73] Assignee: Honda Giken Kogyo Kabushiki Kaisha, Tokyo, Japan

[21] Appl. No.: 932,490

[22] Filed: Nov. 20, 1986

[30] Foreign Application Priority Data

Nov. 22, 1985 [JP] Japan ..... 60-264613

[51] Int. Cl.[4] ..... F02M 51/00

[52] U.S. Cl. ..... 123/489; 123/492

[58] Field of Search ..... 123/440, 489, 492, 493

[56] References Cited

U.S. PATENT DOCUMENTS 4,359,029 11/1982 Furuhashi et al. ..... 123/489
4,375,797 3/1983 Otsuka et al. ..... 123/489 X
4,467,769 8/1984 Matsumura ..... 123/489
4,483,301 11/1984 Yamada et al. ..... 123/489
4,494,512 1/1985 Kishi et al. ..... 123/489

*Primary Examiner*—Willis R. Wolfe, Jr.
*Attorney, Agent, or Firm*—Birch, Stewart, Kolasch & Birch

[57] ABSTRACT

A method for controlling air-fuel ratio of the mixture to be supplied to the engine detects whether or not the amount of the fuel to be supplied to the engine is greater than a reference amount. A feedback control in which the air/fuel ratio is corrected according to an oxygen concentration in the exhaust gas is performed when the amount of the fuel to be supplied to the engine is equal to or smaller than the reference level, while an open loop control in which the air/fuel ratio of the mixture is determined irrespective of the oxygen concentration is performed if an operational state of the engine in which the amount of the fuel to be supplied to the engine is greater than the reference level has continued for more than a predetermined time period.

6 Claims, 4 Drawing Sheets

METHOD FOR CONTROLLING AIR/FUEL RATIO OF FUEL SUPPLY SYSTEM FOR AN INTERNAL COMBUSTION ENGINE

BACKGROUND OF THE INVENTION

1. Field of the Invention

The present invention generally relates to a method for controlling the air/fuel ratio of a fuel supply system for a internal combustion engine.

2. Description of Background Information

In order to supply a proper amount of fuel to an internal combustion engine, a fuel supply system is known in which a basic fuel supply amount is calculated by basic engine parameters, such as a pressure in the intake passage of the engine, in synchronism with the engine rotation. To derive an actual fuel supply amount, an increment or decrement of compensation is applied to the basic fuel supply amount in response to auxiliary engine parameters, such as an engine coolant temperature, or a parameter indicative of a transitional change of the engine operation. The fuel is supplied to the engine using a fuel supply device such as a fuel injector or injectors during time periods each of which corresponds to the actual fuel supply amount derived in the above-mentioned manner.

In the case of this type of fuel supply control system, if a three-way catalytic converter is provided in an exhaust system of the engine for the purification of the exhaust gas, the operation of the three-way catalytic converter is optimized when the air/fuel ratio of the mixture is controlled at around a stoichiometric value (14.7:1, for instance).

For satisfying this requirement, an arrangement is generally utilized in which oxygen concentration in the exhaust gas is detected as one of the engine parameters by means of an oxygen concentration sensor (abbreviated as $O_2$ sensor hereinafter) provided in the exhaust system. The basic fuel supply amount is corrected in accordance with an output signal of the $O_2$ sensor so as to effect a feedback control operation through which the air/fuel ratio of the mixture supplied to the engine is controlled to the stoichiometric value.

However, feedback control of the air/fuel ratio is not always effected. During a predetermined operating condition of the engine such as in a state where the engine coolant temperature is low, or during a high load operating condition of the engine, the air/fuel ratio is enriched by an open loop control where the air/fuel ratio is determined irrespective of the output signal of the $O_2$ sensor.

In addition, in this type of fuel supply control system, the air/fuel ratio is enriched by increasing the fuel supply amount when the engine is operating under a high load condition. Because it is inconvenient if the feedback control of the air/fuel ratio is performed during the period of fuel increment control, a control method is disclosed in Japanese Patent application laid open No. 59-548 in which, when the fuel supply amount exceeds a predetermined value, it is detected that the engine is operating under a high load condition and the open loop control is selected instead of the feedback control of the air/fuel ratio.

However, if the high load condition is determined from the fuel supply amount and the air/fuel ratio is enriched when the fuel supply amount becomes greater than the predetermined value, the air/fuel ratio is also enriched for a short-time during acceleration of the vehicle. Such an enrichment of the air/fuel ratio will result in an increase of the emission of carbon monoxide (CO), to reduce the efficiency of purification of the exhaust gas.

SUMMARY OF THE INVENTION

An object of the present invention is therefore to provide a method for controlling air/fuel ratio of the mixture to be supplied to the engine in which an improvement of the driveability of the engine under a high load condition and an improvement of the exhaust gas purification are consistent with each other.

According to the present invention, a method for controlling air/fuel ratio of the mixture to be supplied to the engine includes a step for detecting whether or not an amount of fuel to be supplied to the engine is greater than a reference amount, a step for correcting an air/fuel ratio of the mixture to be supplied to the engine in response to an oxygen concentration in an exhaust gas of the engine so as to perform a feedback control when the amount of fuel to be supplied to the engine is equal to or smaller than the reference amount, and a step for correcting the air/fuel ratio of the mixture irrespective of the oxygen concentration when an operating state of the engine in which the amount of fuel to be supplied to the engine is greater than the reference amount has continued for more than a predetermined time period.

Further scope and applicability of the present invention will become apparent from the detailed description given hereinafter. However, it should be understood that the detailed description and a specific example, while indicating a preferred embodiment of the invention, are given by way of illustration only, since various changes and modifications within the spirit and scope of the invention will become apparent to those skilled in the art from this detailed description.

BRIEF DESCRIPTION OF THE DRAWINGS

FIGS. 3 and 4 are flow charts showing the operation of the control circuit as an embodiment of the present invention, in which FIG. 3 shows steps of a $K_{O2}$ subroutine, and FIG. 4 shows steps of a $K_{WOT}$ subroutine.

DETAILED DESCRIPTION OF A PREFERRED EMBODIMENT

An embodiment of the air/fuel ratio control method of the present invention will be explained with reference to FIGS. 1 through 4 of the accompanying drawings.

Figure 1:
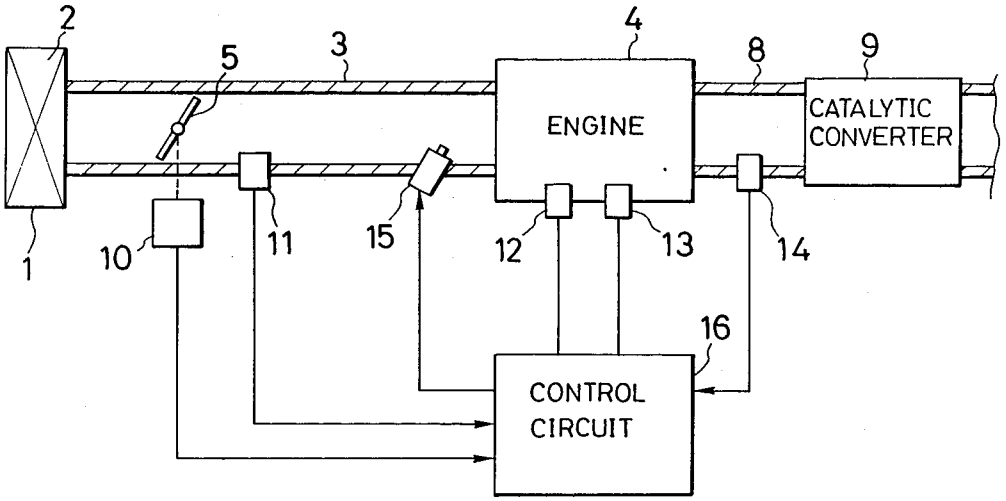
FIG. 1 is a schematic diagram showing an electronically controlled fuel injection system in which the air/fuel ratio control method of the present invention is applied.

In FIG. 1, intake air taken at an air inlet port is supplied to an internal combustion engine 4 through an air cleaner 2, and an intake air passage 3. A throttle valve 5 is disposed in the intake air passage 3 so that the amount of the air taken into the engine is controlled by an opening angle thereof. In an exhaust passage 8 of the engine 4, a three-way catalytic converter 9 is provided so as to accelerate the reduction of the noxious components (CO, HC, and NOx) in the exhaust gas.

The reference numeral 10 indicates a throttle position sensor made up of a potentiometer for example and producing an output voltage whose level is responsive to the opening angle of the throttle valve 5. Also, an absolute pressure sensor 11 is provided, in the intake air passage 3, on the downstream side of the throttle valve 5 so as to produce a voltage level corresponding to the magnitude of the absolute pressure in the intake air passage 3, downstream of the throttle valve 5. An engine coolant temperature sensor 12 is provided so as to produce a voltage level proportional to the temperature of the engine coolant. A crank angle sensor 13 is provided which produces pulse signals in accordance with the rotation of the crankshaft of the engine such a manner that a pulse signal is produced for every 180° rotation of the crankshaft, for example. In the exhaust passage 8, an oxygen concentration sensor 14 is provided, on the upstream side of the three-way catalytic converter 9, so that a voltage representing the oxygen concentration in the exhaust gas is produced. The reference numeral 15 indicates an injector provided in the intake air passage 3 of the engine, near an inlet valve (not shown).

Output terminals of the throttle position sensor 10, absolute pressure sensor 11, engine coolant temperature sensor 12, crank angle sensor 13, and oxygen concentration sensor 14, and an input terminal of the injector 15 are connected to a control circuit 16.

Figure 2:
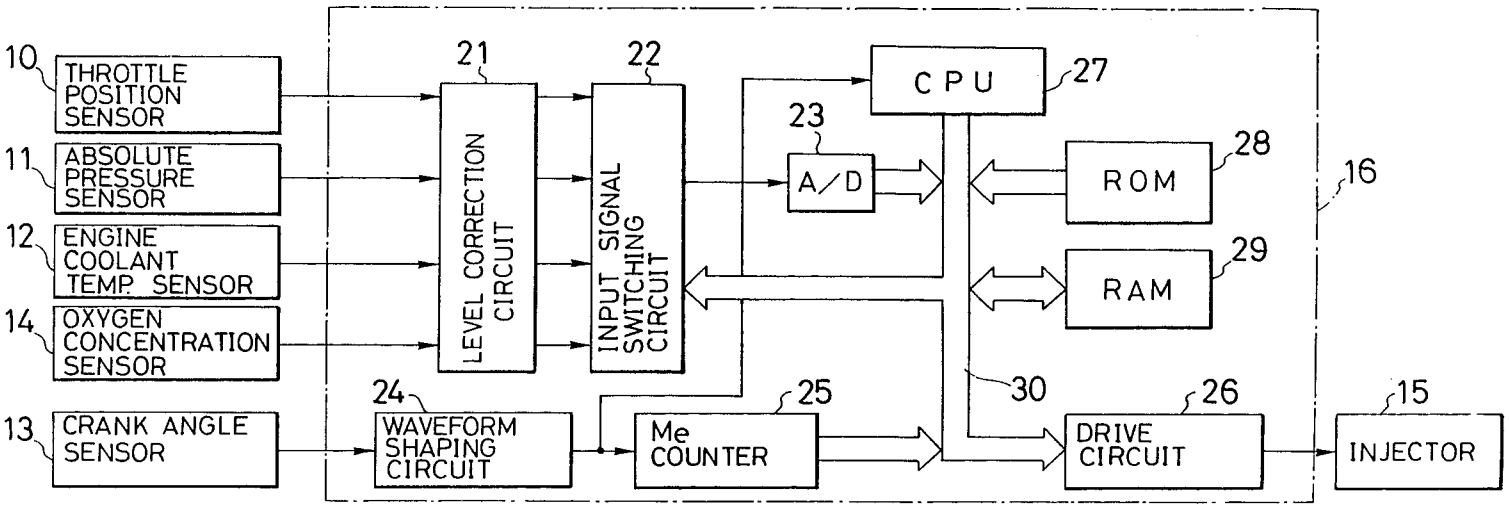
FIG. 2 is a block diagram showing the concrete construction of the control circuit utilized in the system of FIG. 1.

As shown in FIG. 2, the control circuit 16 is made up of a level correction circuit 21 for correcting the level of output signals of the throttle position sensor 10, absolute pressure sensor 11, the engine coolant temperature sensor 12, oxygen concentration sensor 14. Output signals of the level correction circuit 21 are supplied to an input signal switching circuit 22 for selectively transmitting one of the output signals of the level correction circuit 21. An output signal of the level correction circuit 21 which is produced in analog form is then supplied to an A/D (analog to digital) converter 23 where the input analog signal is converted into a digital signal. The control circuit 16 further includes a waveform shaping circuit 24 for an output signal of the crank angle sensor 13, an Me couter 25 for counting the time interval between each pulse of TDC (top dead center) signal supplied from the waveform shaping circuit 24, a drive circuit of the injector 15, a CPU (central processing unit) 27 for performing digital arithmetic operations according to predetermined programs, a ROM 28 in which various programs are stored, and a RAM 29. The input signal switching circuit 22, the A/D converter 23, the Me counter 25, a drive circuit 26 for driving the injector 15, the CPU 27, the ROM 28 and the RAM 29 are mutually connected by means of an input/output bus 30. Also, the TDC signal produced at the waveform shaping circuit 24 is supplied to the CPU 27.

With this circuit construction, information indicative of the throttle valve opening degree, absolute value in the pressure passage, engine coolant tamperature, and oxygen concentration in the exhaust gas is selectively supplied from the A/D converter 23 to the CPU 27, and a counter value information indicative of an inverted value of the engine rpm is supplied from the Me counter 25 to the CPU 27, both via the input/output bus 30. In the ROM 28, computing programs and various data for the arithmetic operation in the CPU 27 are stored previously.

The CPU 27 reads-in the above-mentioned various information in accordance with the program stored in the ROM 28 and calculates a fuel injection time $T_{OUT}$ of the injector 15 corresponding to the amount of the fuel supplied to the engine 4 using a calculation formula described later, in response to these information and in synchronism with the TDC signal. The fuel injector 15 is actuated by the drive circuit 26 only for the fuel injection time $T_{OUT}$ so as to supply the fuel to the engine 4.

The fuel injection time $T_{OUT}$ is, for instance, calculated by the following formula:

$$T_{OUT}=T_i\times K_{O2}\times K_{WOT}\times K_{TW} \quad (1)$$

where $T_i$ represents a basic supply amount determined by the engine rotational speed and the pressure in the intake passage, $K_{O2}$ represents a feedback correction coefficient of the air/fuel ratio, $K_{WOT}$ represents a fuel increment correction coefficient for a high load operation, $K_{TW}$ represents a coefficient of the engine coolant temperature. The correction coefficients of $K_{O2}$, $K_{WOT}$, and $K_{TW}$ are calculated or set in subroutines of a main routine of the calculation of fuel injection time $T_{OUT}$.

Next, the operational steps of the method for controlling the air/fuel ratio according to the present invention which are performed by the control circuit 16 will be explained referring to a $K_{O2}$ subroutine and a $K_{WOT}$ subroutine.

Figure 3:
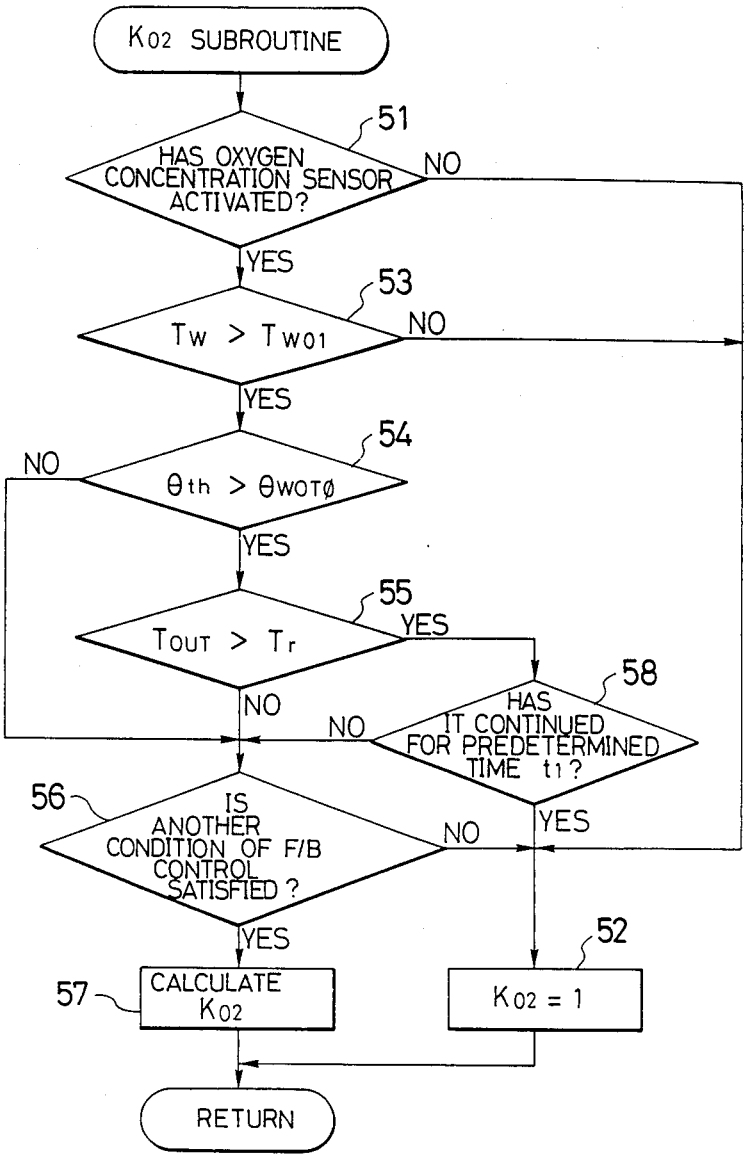

In the $K_{O2}$ subroutine, as shown in FIG. 3, the control circuit 16 detects whether or not the activation of the oxygen concentration sensor 14 has been compeleted at a step 51. Since the voltage level of the output signal $V_{O2}$ of the oxygen sensor 14 varies, as the engine warms up in a lean atmosphere, such that it goes up above a predetermined voltage level $V_x$, and subsequently it falls below the predetermined level, the detection of the activation of the oxygen sensor 14 occurs when a predetermined time period $t_x$ has passed after the level of the output signal $V_{O2}$ of the oxygen sensor 14 has become lower than the predetermined level $V_x$.

When it is detected that the activation of the oxygen sensor is not completed, the feedback coefficient $K_{O2}$ is set approximately at 1 at a step 52 so that the air/fuel ratio control is performed by an open loop operation. On the other hand, if the oxygen sensor 14 is activated, the step 53 determines, whether or not the engine coolant temperature $T_W$ is greater than a temperature level $T_{WO1}$ for starting the feedback control. If $T_w \leqq T_{WO1}$, the program goes to the step 52 so that the open loop control is performed. On the other hand, if $T_w < T_{WO1}$, whether or not the throttle valve opening dgree 0th is greater than a predetermined opening degree $\theta_{WOT0}$ is detected at a step 54. The predetermined opening degree $\theta_{WOT0}$ corresponds to an opening degree, 60° for example, of the throttle valve under its almost fully open state. If $\theta_{th} > \theta_{WOT0}$, it is detected whether or not the fuel injection time $T_{OUT}$ calculated by the subroutine for calculating the fuel injection time $T_{OUT}$ is greater than a reference value Tr at a step 55. If $T_{OUT} \leqq T_r$, whether or not another operating state of the engine which requires the open loop control is satisfied is detected at a step 56. If the detected result indicates that the engine is operating under a state where the open loop control is required, such as in the fuel-cut operation or in the idling of the engine, the program goes to the step 52. On the other hand, if the result of the detection indicates that the operating state of the engine satisfies the condition of the feedback control, the feedback coefficient $K_{O2}$ is calculated at a step 57.

If, at the step 54, $\theta th \leqq \theta_{WOT0}$, the operation of the step 56 is executed immediately. If, on the other hand, $T_{OUT} > T_r$, it is regarded that the engine is operating under a high load state, and whether or not the high load state has continued for more than a predetermined time $t_1$, is detected at a step 58. If the high load state has continued for more than the predetermined time period $t_1$, the operation of the step 52 is executed so that the air/fuel ratio control system operates under the open loop mode. If the high load state has not continued for more than the predetermined time period, whether or not the operating condition of the engine satisfies the other conditions of the feedback control mode, is detected by the execution of the step 56.

In addition, the air/fuel ratio is detected by means of information of oxygen concentration in the exhaust gas under the feedback control mode of the air/fuel ratio. If the detected air/fuel ratio is richer than the stoichiometric air/fuel ratio, the feedback correction coefficient $K_{O2}$ is determined so that the air/fuel ratio is controlled to the lean side. On the other hand, if the detected air/fuel ratio is leaner than the stoichiometric air/fuel ratio, the feedback correction coefficient $K_{O2}$ is determined so that the air/fuel ratio is controlled to the rich side.

Figure 4:
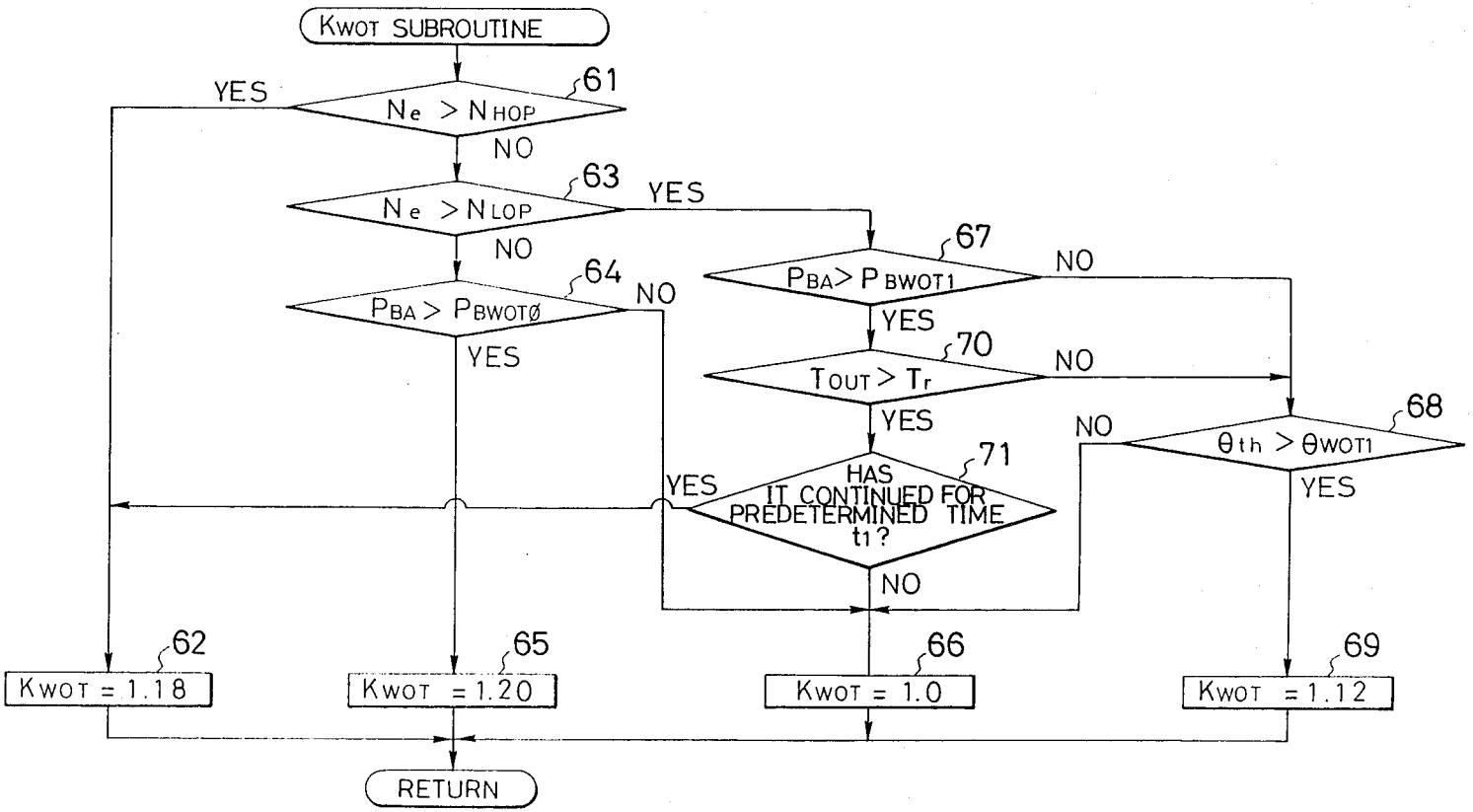

The operation of the $K_{WOT}$ subroutine will be explained with reference to FIG. 4 hereinafter. In this subroutine, whether or not the engine rotational speed $N_e$ is higher than a predetermined speed $N_{HOP}$ (3000 rpm for example) is detected at a step 61. If $N_e > N_{HOP}$ a value 1.18 is set for the fuel increment correction coefficient $K_{WOT}$ at a step 62. Conversely, if $N_e \leqq N_{HOP}$, whether or not the engine speed $N_e$ is higher than a predetermined speed $N_{LOP}$ (1000 rpm for example) is detected at a step 63. If $N_e \leqq N_{LOP}$ at the step 63, it is determined at step 64 whether or not an absolute pressure in the intake pipe $P_{BA}$ is greater than a predetermined value $P_{BWOT0}$ (600 mmHg for example). If $P_{BA} > P_{BWOT0}$ at the step 64, it indicates that the engine is operating under a high load state in a low speed range, and a value 1.20 is set for the fuel increment correction coefficient $K_{WOT}$ at a step 65. Conversely, if $P_{BA} \leqq P_{BWOT0}$ at the step 64, it is determined that the fuel increment correction is not needed, and a value 1.0 is set for the fuel increment correction coefficient $K_{WOT}$ at a step 66. On the other hand, if $N_e > N_{LOP}$ at the step 63, whether or not the absolute presure $P_{BA}$ in the intake pipe is greater than a predetermined pressure $P_{BWOT1}$ (700 mmHg for example) is detected at a step 67. If $P_{BA} \leqq P_{BWOT1}$, whether or not the throttle valve opening degree $\theta th$ is greater than a predetermined opening value $\theta_{WOT1}$(30° for example) is detected at a step 68. If $\theta th < \theta_{WOT1}$, a value 1.12 is set for the fuel increment correction coefficient $K_{WOT}$ at a step 69. On the other hand, if $\theta th \leqq \theta_{WOT1}$, the fuel increment correction coefficient $K_{WOT}$ is made equal to the value 1.0 at the step 66. If $P_{BA} > P_{BWOT1}$ at the step 67, whether or not the fuel injection time $T_{OUT}$ calculated by the subroutine for calculating the fuel injection time $T_{OUT}$ is greater than the reference value $T_r$, is detected at a step 70. If $T_{OUT} \leqq T_r$, the operation of the step 68 is performed. Conversely, if $T_{OUT} > T_r$, it is regarded that the engine is operating under the high load state, and whether or not the high load state has continued for more than a predetermined time period t1, is detected at a step 71. If the high load condition has continued for more than the predetermined time period t1, the value 1.18 is set for the fuel increment correction coefficient $K_{WOT}$ at the step 62. If the high load state has not continued for more than the predetermined time period $t_1$, the value 1.0 is set for the fuel increment correction coefficient by the operation of the step 66, so as not to effect the fuel increment control.

The detection operations at the steps 58 and 71 are performed by using a count value of the time counter incorporated in the control circuit 16 whose count operation is started after the detection of a result of detection that the fuel injection time $T_{OUT}$ is greater than the reference value Tr at the step 55 or 70. In addtion, the time counter is reset to an initial value every time of the execution of the $K_{O2}$ subroutine or the $K_{WOT}$ subroutine if the operation of the step 58 or the step 71 is not executed. Moreover, the detection as to whether or not the fuel injection time period $T_{OUT}$ is greater than the reference value $T_r$ and the detection as to whether or not the operating condition in which $T_{OUT} > T_r$ has continued for more than the predetermined time period can be executed in a calculation subroutine different from the $K_{O2}$ subroutine and the $K_{WOT}$ subroutine. In that case, results of the detection may be suitably memorized in the form of flags, and the contents of the flags are read in the $K_{O2}$ subroutine and the $K_{WOT}$ subroutine respectively.

It will be appreciated from the foregoing, according to the air/fuel ratio control method of the invention, the feedback control of air/fuel ratio responsive to the oxygen concentration in the exhaust gas is stopped to enrich the air/fuel ratio of the mixture when the high load state of the engine operation in which the amount of the fuel to be supplied to the engine is greater than the reference level has continued for more than the predetermined time period.

Therefore, the driveability of the vehicle when the engine is operating under a high load condition is improved while preventing the enrichment of the air/fuel ratio caused by the increment of the fuel supply amount during a temporary acceleration of the vehicle. Thus, the emission of exhaust gas components such as carbon monoxide is reduced, to improve the efficiency of the exhaust gas purification.

What is claimed is:

1. A method for controlling an air/fuel ratio of mixture to be supplied to an internal combustion engine having a fuel supply system, comprising the steps of:

detecting whether or not an amount of the fuel to be supplied to the engine by means of said fuel supply system is greater than a reference amount;

correcting the air/fuel ratio of the mixture to be supplied to the engine in response to an oxygen concentration in an exhaust gas so as to perform a feedback control when the amount of the fuel to be supplied to the engine is equal to or smaller than the reference amount; and using open loop control to correct the air/fuel ratio of the mixture to be supplied to the engine irrespective of said oxygen concentration only when the amount of the fuel to be supplied to the engine is greater than the reference amount for more than a predetermined time duration greater than zero.

2. A method as set forth in claim 1, wherein said fuel supply system is a fuel injection system, and wherein the established fuel amount corresponds to a fuel injection time period and the reference fuel amount corresponds to a reference time period.

3. A method for controlling an air/fuel ratio of the mixture to be supplied to an internal combustion engine having a fuel supply system and an exhaust system provided with an oxygen concentration sensor, while establishing an amount of fuel to be supplied to the engine through said fuel supply system, comprising the steps of:

calculating an established amount of the fuel on the basis of engine operating parameters including an output signal of said oxygen concentration sensor so as to perform feedback control as long as the established amount of the fuel is equal to or smaller than a reference fuel amount;

continuing the feedback control while the established amount of fuel is greater than said reference fuel amount during said predetermined time period greater than zero; and performing open loop control by correcting the calculated amount of the fuel irrespective of an output signal of said oxygen concentration sensor to enrich the amount of the fuel when the established amount of fuel is greater than said reference fuel amount for more than said predetermined time period.

4. A method as set forth in claim 3, wherein said fuel supply system is a fuel injection system, and wherein the established fuel amount corresponds to a fuel injection time periond and the reference fuel amount corresponds to a reference time period.

5. A method for controlling an air/fuel ratio of mixture to be supplied to an internal combustion engine having a fuel supply system and an exhaust system provided with an oxygen concentration sensor, while establishing an amount of fuel to be supplied to the engine through said fuel supply system, comprising the steps of:

calculating an established amount of the fuel on the basis of engine operating parameters including an output signal of said oxygen concentration sensor so as to perform feedback control as long as the established amount of the fuel is equal to or smaller than a reference fuel amount;

continuing the feedback control while the established amount of fuel is greater than said reference fuel amount during said predetermined time period greater than zero; and performing open loop control by correcting the calculated amount of the fuel irrespective of an output signal of said oxygen concentration sensor to enrich the amount of the fuel when the established amount of fuel is greater than said reference fuel amount for more than said predetermined time period, until the calculated amount falls below said reference amount.

6. A method as set forth in claim 5, wherein said fuel supply system is a fuel injection system, and wherein the established fuel amount corresponds to a fuel injection time period and the reference fuel amount corresponds to a reference time period.

* * * * *